US005657674A

United States Patent [19]

Burnett

[11] Patent Number: 5,657,674

[45] Date of Patent: Aug. 19, 1997

[54] COMPOSITE PERCUSSIVE TOOL

[76] Inventor: John A. Burnett, 1663 Paradise Dr., Burlington, Wis. 53105

[21] Appl. No.: 634,275

[22] Filed: Apr. 18, 1996

[51] Int. Cl.[6] ..... B25D 1/12

[52] U.S. Cl. ..... 81/22; 81/20

[58] Field of Search ..... 81/20, 22

[56] References Cited

U.S. PATENT DOCUMENTS

| | | | |
|---|---|---|---|
| 1,045,145 | 11/1912 | Hubbard . | |
| 2,604,914 | 7/1952 | Kahlen | 145/36 |
| 2,702,060 | 2/1955 | Bonnesen | 81/22 X |
| 2,928,444 | 3/1960 | Ivins | 145/29 |
| 2,940,492 | 6/1960 | Curry et al. | 145/61 |
| 3,030,989 | 4/1962 | Elliott | 81/22 |
| 3,704,734 | 12/1972 | Soto et al. | 145/29 B |
| 3,844,321 | 10/1974 | Cook | 145/29 R |
| 4,039,012 | 8/1977 | Cook | 145/29 R |
| 4,697,481 | 10/1987 | Maeda | 81/22 |
| 5,012,702 | 5/1991 | Taylor | 81/25 |
| 5,408,902 | 4/1995 | Burnett | 81/22 |

*Primary Examiner*—James G. Smith
*Attorney, Agent, or Firm*—Rudnick & Wolfe

[57] ABSTRACT

A composite hammer is provided having enhanced vibration dampening characteristics. In one aspect of the invention, the composite hammer includes a handle having an elongated body and a cradle attached to a terminal end of the body. An elastomeric member substantially encapsulates the cradle and at least partially encapsulates a head structure to thereby secure the head structure to said handle. In another aspect of the invention, the hammer includes a substantially rigid elongated body having a chamber therein. An elastomeric material filler is positioned within the chamber of the hammer body to thereby enhance the vibration dampening characteristics of said hammer.

37 Claims, 4 Drawing Sheets

COMPOSITE PERCUSSIVE TOOL

FIELD OF THE INVENTION

The present invention generally relates to percussive tools and, more particularly, to a composite percussive hand tool such as a hammer configured to dampen vibrations and suppress rebound when the tool is struck against a surface to lessen the shock to the hand of the person using the hammer. The present invention also discloses a method of making a composite hammer.

BACKGROUND OF THE INVENTION

Hammers of many sizes and shapes are available throughout the prior art, and typically comprise a handle portion extending generally normal to and connected to a head potion that serves as the striking end of the hammer. It has been a prevalent practice in the trade to construct the handle portion of hammers from high grade wood. Preferably, a grade of hickory wood is used to form the handle portion because of the desirable characteristics including strength and resiliency. All woods, however, have obviously limited strength and, therefore, are subject to breakage under relatively low stress.

Recently, hammers having an internal metal or steel skeleton surrounded by a molded plastic shell have become increasingly popular. The internal metal skeleton provides the hammer with stiffness and strength while the surrounding plastic shell provides a degree of comfort during use of the hammer. Because of the high density of the steel, however, tools incorporating handles of this type have been found to have poor dynamic qualifies as proper centers of gravity and percussion cannot be obtained if other minimum practical design characteristics are to be met. Another severe drawback with hammers having steel metal skeletons is that the impact at the striking moment is transmitted through the metal hammer body to the users hand, thus increasing efforts and labor of the user and thereby reducing the operating efficiency of the hammer. Moreover, the metal hammer body tends to make the hammer heavy to use and transport.

When a percussive tool such as a hammer is moved to strike a surface of an object, part of the kinetic energy developed is utilized in doing the desired work on the object, part is dissipated as heat, and part is converted into potential energy in the form of distortion in the striking surface of the hammer. Hammer recoil has been encountered with hammer configurations including either exposed striking heads or a skeletal hammer design wherein the hammer heads are wholly received in an encasing to prevent sparking or the like during hammer use. The distortion of the striking surface of the hammer has potential energy much the same way as a compressed spring. It is this potential energy that causes the hammer to recoil or bounce back from the surface of the object being struck.

Various attempts have been proposed to provide an advantageous "dead-blow" characteristic to the hammer when the striking head thereof impacts with the surface being struck. Such a requirement resulted in forming the head portion of the hammer from lead or other suitable shock absorbing materials. These hammers have proven satisfactory for forcing large machine parts into place, but due to their soft and malleable composition have extremely abbreviated usefulness.

To prolong the usefulness of the hammer while continuing to offer the long sought "dead-blow" feel for the hammer, some designers have configured the head portion of the hammer with standard striking heads and a powdered shot filled cavity therebetween to dampen the recoil of the hammer. In an attempt to offer a hammer having advantageous "dead-blow" characteristics, another approach involves configuring the hammer head portion with a series of slidable slugs arranged behind the striking head of the hammer. A recent and innovative tool design yielding significant advantages in the ability to provide the hammer with a "dead-blow" characteristic involves configuring the head potion of the hammer with operably coupled yet split striking heads.

Thus, there is both a need and a desire for a lightweight percussive tool which provides a so called "dead-blow" characteristic by preventing rebounding of the striking head on the hammer and which reduces the impact or vibration transmitted through the tool to the user thereof.

SUMMARY OF THE INVENTION

In view of the above, and in accordance with the present invention, there is provided a hand tool such as a hammer formed from composite materials and including a head portion and a handle portion forming a generally T-shaped integral body and that is available for use in a wide variety of various fields such as construction and assembly shops and sites. The head portion of the hammer includes a pair of striking heads forming part of a head structure that may take any suitable configuration for suppressing struck end rebound thereby offering an advantageous "dead-blow" characteristic during use of the hammer while being integrally coupled to the handle portion. The handle portion is formed from composite materials advantageously offering the same or greater tensile and flexural strength as compared to wood or steel coupled with impact resistance particularly in the throat region wherein the handle portion is joined to the head portion.

According to a preferred embodiment of the present invention, the handle portion of the bummer includes an elongated rigid body of thermoplastic material embedded within a molded polyurethane outer shell. The outer shell encapsulates the hammer body and the head structure of the hammer and inhibits the striking heads from separating from the hammer. The thermoplastic material used to form the hammer body is reinforced with long glass fibers randomly mixed with and forming a ratio of about 50% to about 60% of the thermoplastic material used to form the hammer body. In addition to adding strength and rigidity to the handle portion of the hammer, the bummer body offers shock dampening qualities adequate to inhibit unpleasant transfer of shock to the hand of the user.

The body of the hammer includes an elongated member with a cradle connected to and extending generally normal to the elongated member. The cradle serves as a support for the head structure of the hammer. Preferably, the elongated member and the cradle of the hammer body are integrally formed with each other. In a preferred embodiment, the elongated member defines a tube-like cavity extending the entire length of the body. Forming the body of the hammer from a thermoplastic resin reinforced with glass fibers offers a design having considerably lower density than heretofore known steel inserts or skeletons previously used in hammers.

In a preferred embodiment of the invention, the cradle of the hammer body has a recess or channel-like configuration in which the striking heads of the hammer are arranged in axial alignment relative to each other. When the outer shell of the hammer is molded about the body, a portion of the outer shell surrounds the striking heads of the hammer thereby maintaining the striking heads in operable combination with the hammer.

Another aspect of the present invention relates to a method of manufacturing a composite hammer. The method of making a composite hammer comprises the steps of: suspending in a mold a rigid body of thermoplastic nylon resin reinforced with glass fibers comprising between about 50% to about 60% of the hammer body, with said body having a first elongated section and a second section extending generally normal to and from one end of said first section, and wherein said second section defines a recess or channel; arranging in the recess or channel of the second section of said body a pair of split striking heads such that said striking heads are in axial alignment relative to each other; and casting polyurethane material into said mold and about said body and about at least a lengthwise portion of said heads to establish an elastomeric link between said striking heads whereby the heads are joined to each other in a manner to suppress vibrations and rebound when one of said heads strikes an object, and wherein said polyurethane material is directed through an elongated void defined by the first elongated section of said body such that a handle portion of said hammer is configured with a central body of elastomeric material serving to inhibit shock and vibrations being transferred from said head structure to the handle portion of hammer when an object is struck.

Accordingly, the design of the present invention provides a hammer that has a head portion that suppresses struck end rebound and a handle portion having a reinforced hammer body offering advantageous characteristics for percussive tool applications. That is, the reinforced handle portion of the tool is configured to offer high tensile and flexural strength characteristics while inhibiting the transference of vibrations to the hand of the person using the hammer.

These and other numerous objects, aims, and advantages of the present invention will become readily apparent from the following detailed description of the invention, the appended claims and the accompanying drawings.

DETAILED DESCRIPTION OF A PREFERRED EMBODIMENT

Figure 1:
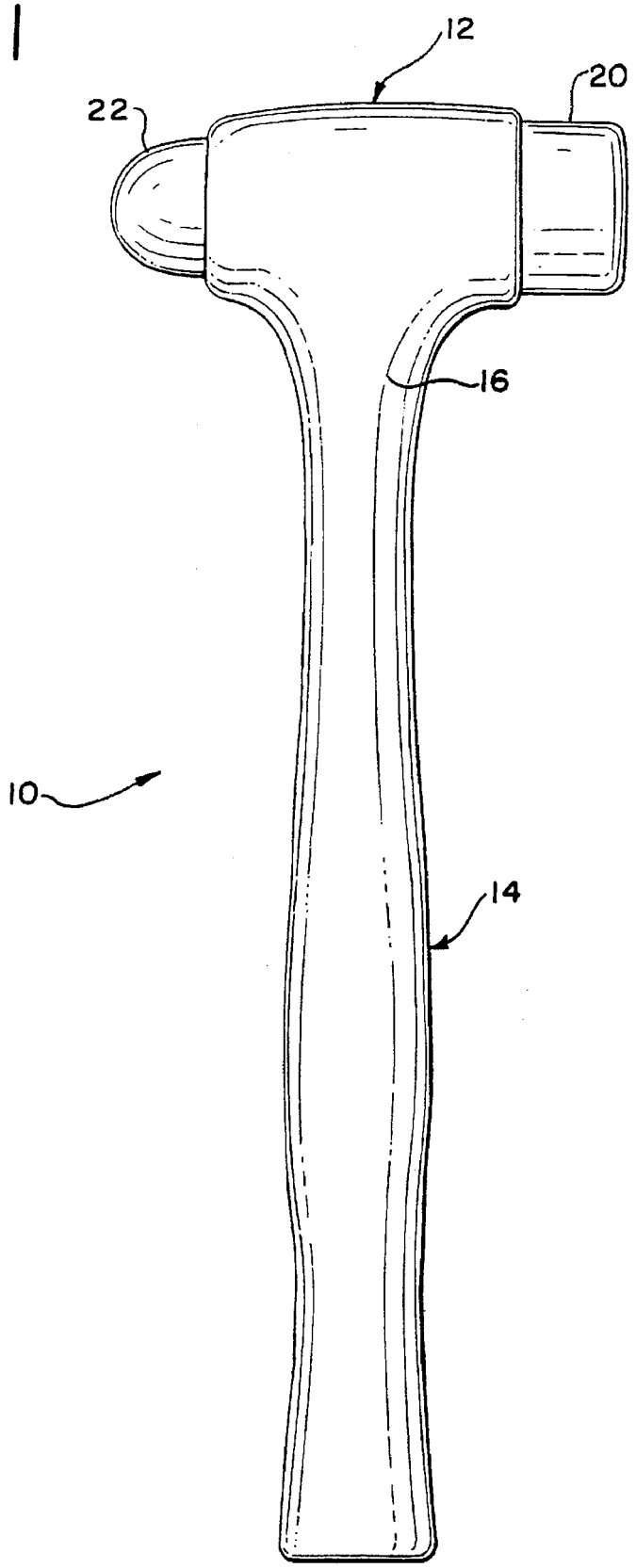
FIG. 1 is a side elevational view of the percussive tool of the present invention.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Figure 2:
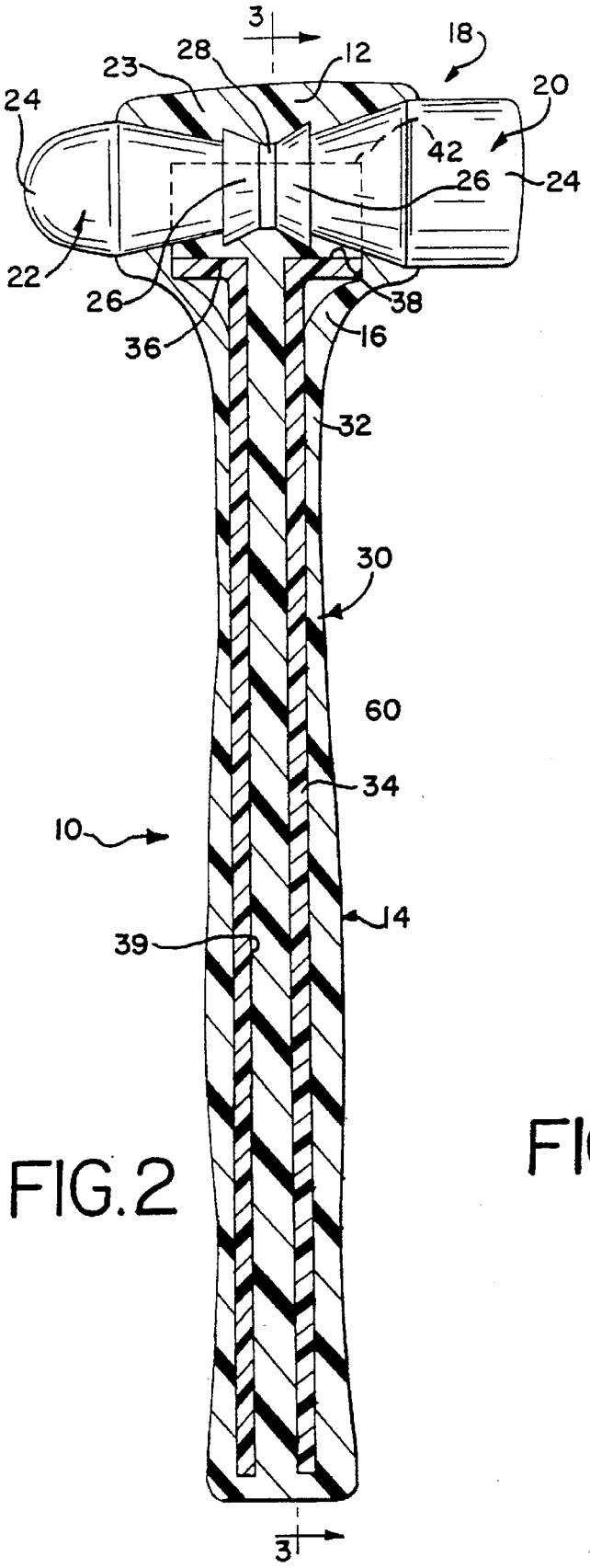
FIG. 2 is a longitudinal sectional view of the percussive tool illustrated in FIG. 1.
Figure 3:
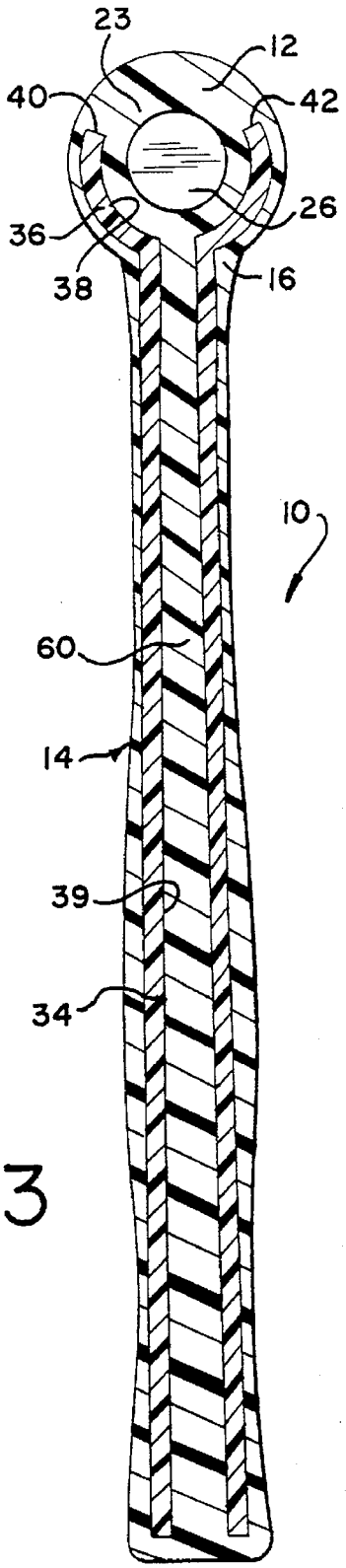
FIG. 3 is a sectional view taken along line 3—3 of FIG. 2.

Referring now to the drawings, wherein like reference numerals refer to like parts throughout the several views, there is shown in FIGS. 1 through 3 a preferred embodiment of a composite tool 10 constructed in accordance with the present invention. The tool of the present invention is exemplified for purposes of this disclosure as being in the form of a hammer having a generally T-shape configuration including a head portion 12 integrally connected to a handle portion 14 at a throat region 16 of the hammer.

As shown in FIG. 2, the head potion 12 of hammer 10 includes head structure 18 including two split heads 20 and 22 extending toward opposite sides of the hammer 10. The striking heads 20, 22 are preferably fabricated from a suitable metal or metal alloy. In a most preferred form, each striking head 20, 22 is formed from a 4140 steel. It should be appreciated, however, that other materials will equally suffice. As is conventional, the striking heads 20, 22 are arranged in general axial alignment relative to each other. Suffice it to say, the head structure 18 is configured to substantially reduce if not eliminate struck end rebound of the hammer 10.

As will be described below, in the illustrated embodiment shown in FIG. 2, each striking head 20, 22 of the head structure 18 includes an enlarged head portion 24 and a shank portion 26. In the illustrated embodiment, the shank potion 26 is integrally connected to the head portion 24 of each striking head 20, 22. Notably, in the illustrated form of the head structure 18, the shank potion 26 of striking head 20 is axially spaced or separated by a gap 28 from the shank portion 26 of striking head 22. For a more detailed description of the head structure 18, the reader's attention is directed to U.S. Pat. No. 5,408,902 issued to J. A. Burnett on Apr. 25, 1995; the full disclosure of which is incorporated herein by reference. As will be appreciated, the configuration of the head structure 18 can be other than the striking heads 20, 22 as shown without detracting or departing from the spirit and scope of the present invention.

In the illustrated embodiment of the invention, the striking heads 20, 22 are elastomerically joined to each other by an elastomeric member 23 to advantageously provide a unique "dead blow" characteristic during use of the hammer 10. The elastomeric connection between the otherwise split heads 20, 22 allows the unstruck head of the hammer 10 to act as a lagging mass that suppresses the struck end rebound of the tool. That is, the head structure 18 is specifically designed to allow a degree of movement between the heads 20,22 such that when one head is impacted against a surface of an object, the second head moves toward the impacted head thereby providing a secondary blow that keeps the struck head from bouncing relative to the struck object.

Although the split head design illustrated in the drawings presents significantly improved results over the other devices, it should be appreciated that the present invention is not limited to hammers having split head designs. To the contrary, the present invention is configured for use with any head structure, although it is especially advantageous for head structures configured to inhibit struck end rebound of the hammer. For example, the present invention is equally applicable to hammers having a head structure that relies on a shot filled cavity for inhibiting struck end rebound of the hammer. Moreover, and as will be appreciated from a full and complete understanding of the present invention, the teachings of the present invention are equally applicable to hammers having a head structure configured with sliding slugs arranged behind the striking heads of the hammer.

As shown in FIGS. 2 and 3, the handle portion 14 of hammer 10 has an elongated configuration that includes an elongated rigid body 30 configured to match the stiffness of wood especially in the throat or neck region of the hammer where the head and handle portions 12 and 14, respectively, are joined to each other. As illustrated in the drawings, the hammer body 30 is embedded within an outer shell 32 formed from an impact absorbing polyurethane resin material that is cast-molded to provide the desired shape of the hammer 10.

The hammer body 30 is of substantially rigid construction and includes an elongated section 34 extending substantially the full length of the handle portion 14 of the hammer 10 and a cradle 36 extending generally normal to and from the elongated handle section 34. In the illustrated embodiment, section 34 preferably has a generally cylindrical cross-sectional configuration, although any shape would suffice, including configurations wherein the hammer body 30 has an I-beam shaped central cross-section. Notably, the cradle 36 of the hammer body 30 defines a recess or channel 38 suitably configured to accommodate and support the head structure 18 of the hammer 10 therewithin. In a most preferred form of the invention, the elongated section 34 of hammer body 30 defines an elongated bore or cavity 39 that opens at one end to the recess 38 defined in the cradle 36 of the hammer body 30 and at an opposite end to a distal end of the handle section 36 of the hammer body 30.

For reasons discussed in detail below, the cradle 36 of the hammer body 30 preferably defines opposing open ends 40 and 42 that are separated from each other. That is, the cradle 36 is preferably configured as a semi-cylindrical wall defining an open channel. Moreover, the cradle 36 of the hammer body 30 extends generally normal to and is preferably formed integral with the handle section 34. It is contemplated that the handle section 34 and cradle 36 of the hammer body 30 could be separately formed but rigidly joined to each other in the manner illustrated to provide the necessary support for the head structure 18 accommodated within the cradle 36 of the hammer body 30. Thus, the elastomeric member 23 acts to secure the head structure 18 to the cradle 36 as well as securing the individual striking heads 20, 22 to each other.

To substantially eliminate transference of shock from the head structure 18 to the handle portion 14 of the hammer 10, the hammer body 30 is preferably fabricated from a long glass fiber reinforced thermoplastic material such as nylon. A long fiber reinforced thermoplastic material sold by Celanese Corporation under the Product Names of N66G50-02-4 or N66G60-02-4 are examples of the of material that have proven remarkable in reducing the transference of shock to the worker's hand holding the handle portion 14 of the hammer 10. Suffice it to say, a suitable long fiber reinforcement having a ratio in the range of about 50% to about 60% is dispersed randomly throughout the thermoplastic material used to form of the hammer body 30. Moreover, in a most preferred from of the invention, the hollow handle segment 34 of the hammer body 30 has a wall thickness between about 0.050 inches and about 0.100 inches to provide the desired stiffness to the hammer 10. Extensive testing has revealed that it is possible to vary the transference of shock through the handle portion 14 of the hammer 10 as a function of the wall thickness of the handle segment 34 of the hammer body 30.

Figure 4:
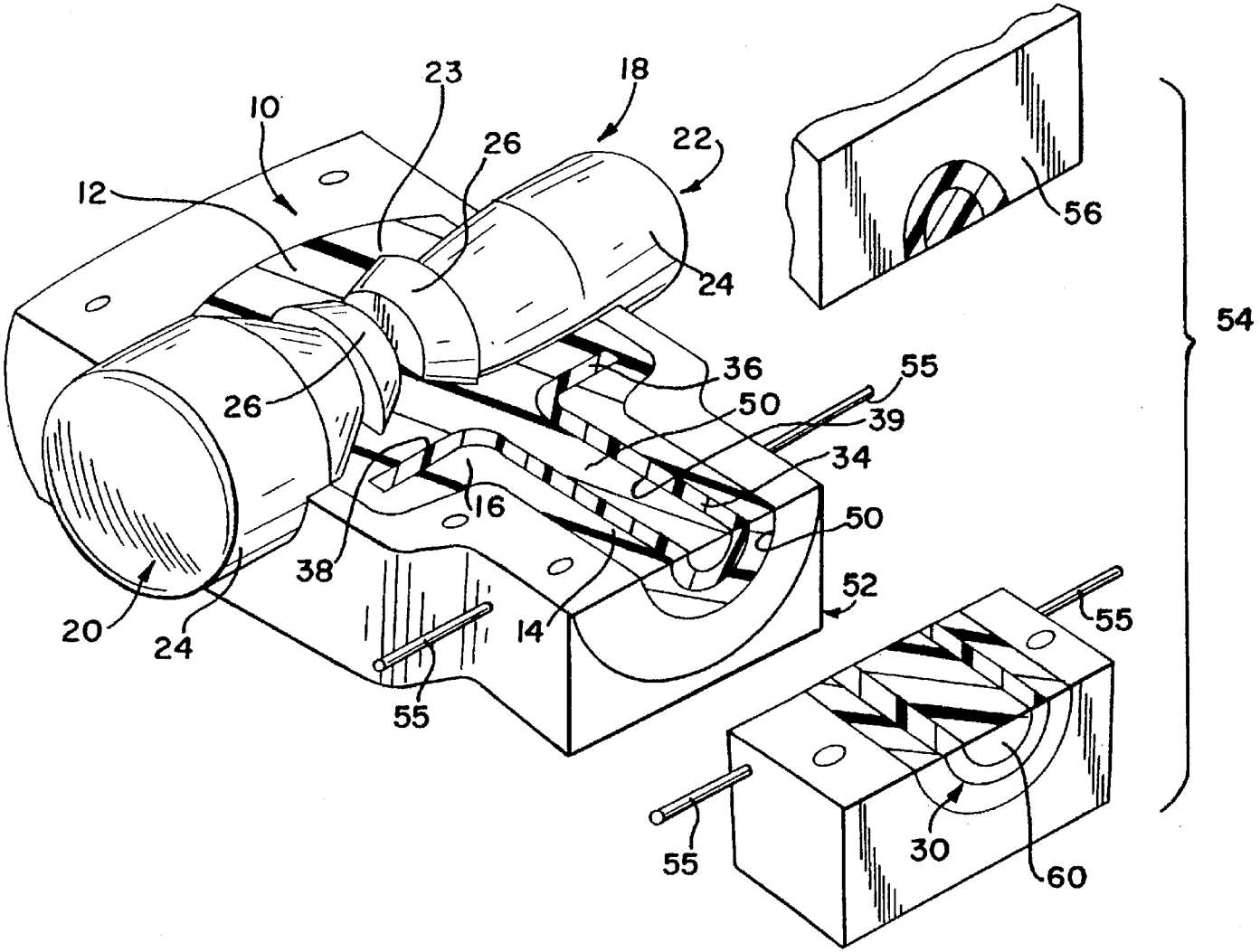
FIG. 4 is a perspective view of parts of a mold set used in forming the hammer shown in FIGS. 1–3.

Referring now to FIG. 4, a preferred method or technique for forming the tool 10 involves pre-forming the hammer body 30. The glass filled nylon referred to above is initially obtained in the form of pellets about 0.500 inches long and 0.125 inches wide. The glass fibers in the pellets are oriented longitudinally when in pellet form. The material is then melted into a resin and injection molded into the shape of the hammer body 30, wherein the fibers become entangled in a generally mixed or random orientation.

Once the hammer body 30 is formed, it is conventionally suspended in a cavity 50 defined by a die mold 52 of a two-piece cast-mold die set 54. Preferably, the hammer body 30 is held in place by a plurality of removable pins 55 extending into the cavity 50 of the die mold 52. With the hammer body 30 suspended in the die mold 52, the striking heads 20, 22 are arranged within the recess or channel 38 of the cradle 36 of the hammer body 30. A second die mold 56 of the die set 54 is then moved into operative relation relative to die mold 52 thereby establishing a positive type cast-mold. The die molds 52, 56 of die set 54 are specifically configured to fit about and allow a portion of the striking heads 20,22 to extend axially therebeyound and in predetermined relationship relative to each other and relative to the cradle 36 of the hammer body 30.

After the die molds are arranged in compressive relationship relative to each other, a liquid polyurethane resin material is introduced through the elongated bore 39 of handle section 34 of the body 30 to form a resilient encasement about the head structure 18 and about the hammer body 30. With the illustrated embodiment, when the polyurethane material is introduced through the hollow center 39 of the hammer body 30, a portion of polyurethane is introduced about and between opposing end regions of the striking heads 20, 22. In the illustrated embodiment, the polyurethane introduced around the striking heads serves as the elastomeric link or member 23 that operably joins the split striking heads 20, 22 to each other and also connects the heads 20, 22 to the body 30 of the hammer. Notably, the liquid polyurethane material completely fills the elongated hollow section 34 of the hammer body 30 and defines an elastomeric center 60 for the hammer 10. Once the elastomeric material used to encase the hammer body 30 and form the outer configuration of the hammer 10 hardens, such elastomeric material preferably has a Shore A durometer hardness in the range of about 70 to 95.

In the above described manner, a percussive tool may be molded from glass reinforced composite material wherein variations in the cross-sectional configurations of the hammer body 30 can be readily accomplished to provide the desired shock dampening characteristics while preserving flexural strength for the hammer 10. The low density of the reinforced hammer body 30 and plastic resin center and exterior permits the realization of a tool, and more particularly a hammer, wherein the center of gravity of the assembled tool may be disposed in a such a location preferably in the throat region and proximate the head potion 18 as to advantageously place the center of percussion within the head portion 18 of the hammer 10.

As will be appreciated from an understanding of the present invention, the reinforced hammer body 30 embedded within the hammer 10 advantageously provides the desired high impact resistance characteristic required for hammer handles thereby affording the maximum resistance to breakage. Moreover, in the hammer 10 constructed as stated above, wherein the heads 20, 22 are split from each other and yet joined by an elastomeric link therebetween, the unstruck head serves as a lagging mass and minimizes rebound of the struck head thereby substantially reducing shock transference to the hand of the user.

As mentioned above, the cradle 36 of the hammer body 30 defines opposing ends 40 and 42. Testing has revealed that by separating the ends 40 and 42 of the cradle 36 of the hammer body 30, the propagation of shock from the striking head of the head structure is significantly reduced. Moreover, by utilizing a hammer body of reinforced thermoplastic material rather than steel results in a remarkable reduction of shock given to the worker's hand holding to the handle portion 14 of the tool 10. Thus, and unlike conventional hammers, the hammer 10 of the present invention yields high recoil inhibiting capabilities while concurrently mitigating shock transference to the hand of the worker holding the handle portion 14 of the tool.

Figure 5:
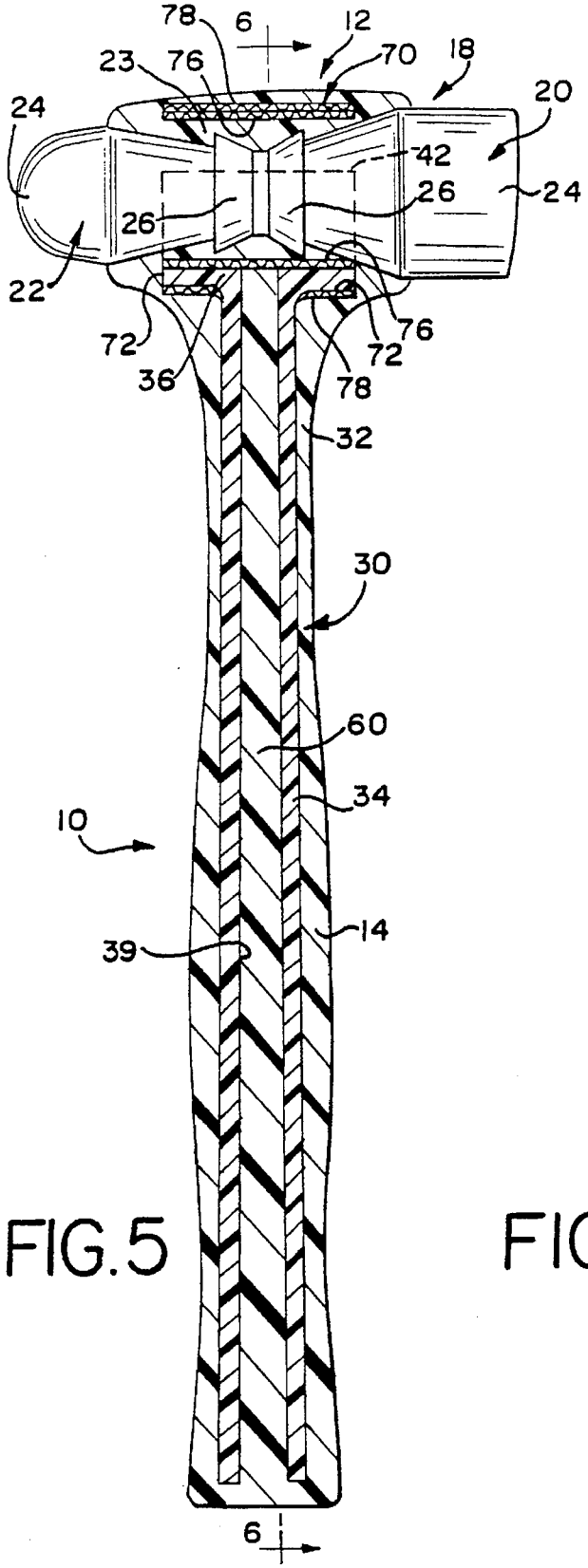
FIG. 5 is a longitudinal sectional view of a most preferred embodiment of the percussive tool.
Figure 6:
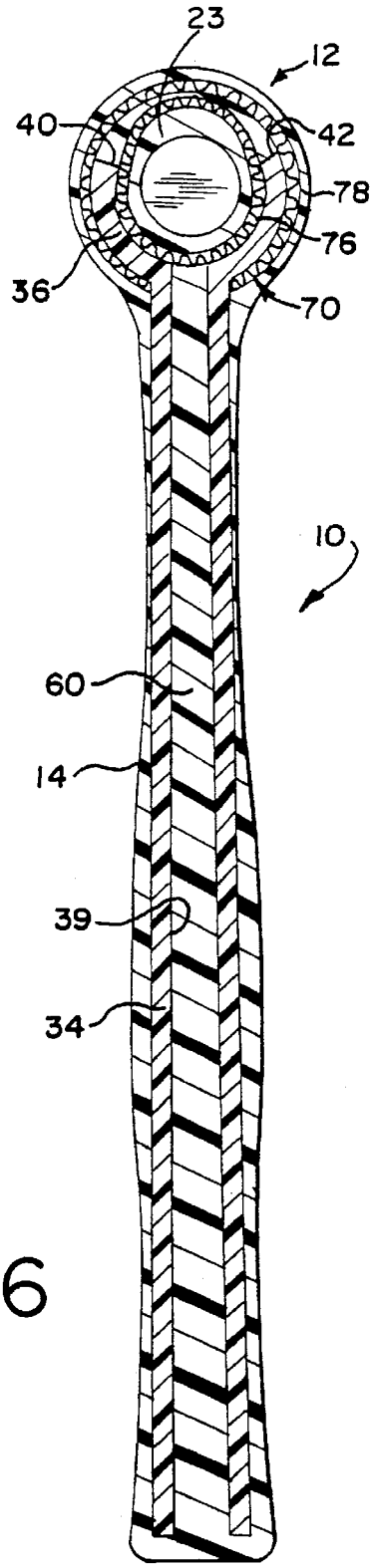
FIG. 6 is a sectional view taken along line 6—6 of FIG. 5.

Referring now to FIGS. 5 and 6, a most preferred embodiment of the present invention is shown illustrating a woven, split-layer mat of fibrous material formed in the shape of a braided sock or tube 70 which surrounds the head structure 18. Since the embodiment shown in FIGS. 5 and 6 is identical to the previously described embodiment, with the exception of the fibrous tube 70, similar parts appearing in FIGS. 5 and 6 are represented by the same, corresponding reference numerals. The fibrous tube 70 is provided to reinforce the elastomeric member 23 in the head region of the hammer so that it can withstand shear forces and/or vibration forces when the head structure 18 strikes an object. As described in more detail above, the elastomeric member 23 secures the head structure 18 to the cradle 36 of the handle body 30. It is also believed that when the head structure 18 strikes an object, the highest concentration of shear forces acting on the elastomeric member 23 occurs at the juncture between the elastomeric member 23 and opposing ends 72 of the cradle 36. By providing a fibrous material near the juncture 72, the stress concentration factor at the juncture may be reduced, thereby minimizing sheer stress acting on the elastomeric member 23. Thus, it is desirable to provide a fibrous material to reinforce the elastomeric member 23 and/or reduce vibration or shear stress acting on the elastomeric member 23.

As shown in FIGS. 5 and 6, the fibrous tube 70 is preferably a split-layer configuration defined by adjacent inner and outer layers 76, 78. A lower section of the tube 70 is open along its length to allow the layers 76, 78 to be slipped over the rigid cradle 36 prior to the cast-molding operation. Once placed over the cradle 36, the split layers 76, 78 follow the contour of the cradle 36 to form the tube shape of the fibrous material. The fibrous tube 70 can then be attached to the cradle 36 in any suitable manner such as by glue or the like, or it can be left loosely attached to the cradle 36. The assembled hammer body 30 with tube 70 attached is then suspended in the die mold 50 in the same manner discussed above, and the striking heads 20, 22 are arranged within the tube 70. Finally, the cast-molding process is performed as described above, and the fibrous tube 70 is impregnated by the polyurethane resin.

Preferably, the tube 70 is made of aramid fibers (sold under the trademark KEVLAR), although any woven fiber such as glass or carbon fiber is within the scope of the invention. The fibrous material does not even need to be a true fiber, so long as it is a material with enough porosity to allow penetration by the polyurethane resin. Also preferably, the tube 70 has a length approximately the same as the length of the cradle 36, and the weave pattern of the tube 70 is a diagonal cross-hatch type pattern.

While the embodiments of the hammer 10 shown in FIGS. 1–6 are illustrated for purposes of disclosure, it is contemplated that other composite hammers having different constructions may be utilized within the scope of the invention. For example, instead of the rigid cradle 36, a cradle of fibrous material could be provided to reinforce the elastomeric member 23 surrounding the head structure 18. The fibrous cradle could be in the same form as tube 70, or it could be an open tube that is merely attached to a terminal end of the hammer body 30 by conventional means. Moreover, the elastomeric material center or filler 60, the elastomeric member 23, and the elastomeric outer shell 32 can be separate components of the composite hammer 10. However, it is desirable to connect these components together, especially in the form of a one-piece molded structure.

The split head tool described above has several advantages over heretofore known tools. Unlike other percussive tools, the composite tool of the present invention has a strong, load beating hollow body or body 30 which surrounds a non-load bearing or flexible internal center 60 of elastomeric material. The inherent characteristic of the elastomeric center 60 provides the desired shock dampening qualifies. Notably, the handle portion 14 of the tool 10 is devoid of any structural member which would normally transmit vibrations to the user of the tool. Instead, the handle portion 14 of the tool 10 is specifically designed to minimize vibrations to the user.

In addition, the time and cost involved in constructing the composite tool is greatly reduced by the molding process of the present invention. Not only is the one-piece configuration of the elastomeric structure easy to produce, it obviates the need to otherwise fixedly connect the link within the head portion of the rigid body.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A composite hammer comprising:

a handle having an elongated body and a cradle attached to a terminal end of said body;

a head structure; and an elastomeric member encapsulating an inner surface portion and an outer surface portion of said cradle and at least partially encapsulating said head structure to thereby secure said head structure to said handle.

2. The composite hammer of claim 1 wherein the cradle is made of a substantially rigid material.

3. A composite hammer comprising:

a handle having an elongated body and a cradle attached to a terminal end of said body, wherein the rigid cradle extends generally perpendicularly from said terminal end of the body and is configured as a semi-cylindrical wall defining an open channel;

a head structure; and an elastomeric member substantially encapsulating said cradle and at least partially encapsulating said head structure to thereby secure said head structure to said handle.

4. A composite hammer comprising:

a handle having an elongated body and a cradle attached to a terminal end of said body, wherein the cradle is made of a fibrous material;

a head structure; and an elastomeric member substantially encapsulating said cradle and at least partially encapsulating said head structure to thereby secure said head structure to said handle.

5. The composite hammer of claim 4 wherein the cradle of fibrous material is configured as a continuous band that surrounds the head structure.

6. The composite hammer of claim 5 wherein the continuous band of fibrous material has a length to define a tube extending perpendicularly from said terminal end of the hammer body.

7. The composite hammer of claim 4 wherein the fibrous material comprises aramid fibers.

8. A composite hammer comprising:

a handle having an elongated body and a cradle attached to a terminal end of said body, wherein the elongated body of the handle member has a longitudinal chamber therein, and an elastomeric material filler extends through said chamber;

a head structure; and an elastomeric member substantially encapsulating said cradle and at least partially encapsulating said head structure to thereby secure said head structure to said handle.

9. The composite hammer of claim 8 further comprising an elastomeric shell encapsulating said elongated body.

10. The composite hammer of claim 9 wherein the elastomeric member, elastomeric material filler, and elastomeric shell are of one-piece construction.

11. A composite hammer comprising:

a handle having an elongated body and a substantially rigid cradle extending generally perpendicularly from a terminal end of said body;

a head structure secured to said cradle by an elastomeric member which substantially encapsulates the cradle; and a fibrous material disposed between the elastomeric member and the cradle.

12. The composite hammer of claim 11 wherein the fibrous material further comprises a split layer section disposed on interior and exterior surfaces of the rigid cradle.

13. The composite hammer of claim 11 wherein the cradle is configured as a semicylindrical wall defining an open channel.

14. The composite hammer of claim 13 wherein the fibrous material comprises a tube of fibrous material that encapsulates the head structure and the cradle, said tube following the contour of said semi-cylindrical wall.

15. The composite hammer of claim 11 wherein the fibrous material is made of aramid fibers.

16. The composite hammer of claim 11 wherein the elongated body of the handle has a longitudinal chamber therein, and an elastomeric material filler extends through said chamber.

17. The composite hammer of claim 16 further comprising an elastomeric shell encapsulating said elongated body.

18. The composite hammer of claim 17 wherein the elastomeric member, elastomeric material filler, and elastomeric shell are of one-piece construction.

19. The composite hammer of claim 18 wherein the elastomeric material filler and elastomeric member are made of a polyurethane material having between 70 and 95 Shore A hardness.

20. The composite hammer of claim 11 wherein the body is formed from long reinforced glass fibers randomly mixed in a thermoplastic material with a fiber percentage ranging between about 50% and about 60%, and wherein said chamber in the body is generally uniform such that said body has a wall thickness between about 0.050 inches and about 0.100 inches to provide the desired stiffness of said hammer.

21. A composite hammer having enhanced vibration dampening characteristics, comprising:

a head structure; and an elongated handle extending from said head structure, said handle including a substantially rigid elongated body having a chamber therein, and an elastomeric material filter positioned within said chamber of the body thereby enhancing the vibration dampening characteristics of said hammer.

22. The composite hammer of claim 21 wherein said elastomeric filler completely fills said chamber.

23. The composite hammer of claim 22 further comprising an outer shell of elastomeric material encapsulating said body and a portion of said head structure.

24. The composite hammer of claim 23 wherein the elastomeric filler and outer shell define a one-piece injection molded vibration dampening member.

25. The composite hammer of claim 21 wherein the head structure comprises a striking head held within a rigid cradle of said hammer body by an elastomeric link fixedly arranged within the cradle, and wherein said cradle extends generally normal to the elongated body of the handle member.

26. The composite hammer of claim 25 wherein said elastomeric filler is connected to the elastomeric link to prevent separation of said elastomeric link from said head section.

27. The composite hammer of claim 26 further comprising an outer shell of elastomeric material encapsulating said rigid body and said cradle, wherein said elastomeric link, said elastomeric material filler and said outer shell define a one-piece injection molded vibration dampening member.

28. The composite hammer of claim 27 wherein the vibration dampening member is made of a polyurethane material having between 70 and 95 Shore A hardness.

29. The composite hammer of claim 21 wherein the body of said handle is formed from long reinforced glass fibers randomly mixed in a thermoplastic material with a fiber percentage ranging between about 50% and about 60%, and wherein said body has a wall thickness between about 0.050 inches and about 0.100 inches to provide the desired stiffness of said hammer.

30. A composite split-head percussive tool having enhanced vibration dampening characteristics, comprising:

an elongated handle including a substantially rigid body defining an axially elongated chamber, a substantially rigid cradle extending generally perpendicularly from a terminal end of said rigid body, and an elastomeric material center extending longitudinally through the length of the chamber to enhance the vibration dampening characteristics of said handle;

a head structure including a pair of split striking heads joined together and secured to said cradle by an elastomeric link;

a fibrous material disposed between the elastomeric link and the cradle; and an outer shell of elastomeric material encapsulating said body and said head structure.

31. The composite percussive tool of claim 30 wherein said elastomeric link, the elastomeric material center, and outer shell define a one-piece molded vibration dampening member.

32. The composite percussive tool of claim 30 wherein the fibrous material layer further comprises a split layer section disposed on interior and exterior surfaces of the cradle.

33. The composite percussive tool of claim 32 wherein the cradle is configured as a semi-cylindrical wall defining an open channel, and the fibrous material layer comprises a tube of fibrous material that encapsulates the head structure and the cradle, said tube following the contour of said semi-cylindrical wall.

34. The composite percussive tool of claim 30 wherein the striking heads are spaced apart to define a gap, and wherein the elastomeric link fills the entire channel except for said gap.

35. A composite hammer having enhanced vibration dampening characteristics, comprising:

a head structure including two opposed heads that are generally aligned relative to each other along an axis, said head structure being configured to suppress vibrations and the struck end rebound of the hammer;

a molded outer shell configured with integral head and handle portions extending in generally orthogonal relation relative to each other, with the head portion of said outer shell supporting said head structure and inhibiting the heads from separating from the hammer, and wherein said outer shell is molded from a polyurethane material; and a rigid hollow inner body of thermoplastic material with reinforcing long glass fibers randomly distributed throughout the thermoplastic-material, said inner body being embedded within said outer shell for adding strength and rigidity thereto and including an elongated handle section and a cradle section extending in opposite directions from the handle section, with said handle section of said inner body being generally aligned longitudinally within the handle portion of said outer shell, and with said cradle of said rigid section extending generally parallel to the axis of and at least partially surrounds the head structure, and wherein the inner body is hollow to permit the polyurethane material of said outer shell to pass and extend through the center of the handle section of said inner body thereby further enhancing vibration dampening characteristics of said hammer.

36. A composite hammer, comprising:

a head assembly having two opposed striking heads that are interconnected to each other along a common axis, said head assembly including structure for suppressing struck end rebound of the hammer;

an inner body including head and handle sections, with said head section of the inner body being arranged generally parallel to said common axis and at least partially surrounds said head assembly, and with the handle section of said inner body extending generally perpendicular to said head section and has a generally hollow configuration along its length, and wherein said inner body is formed from long reinforced glass fibers randomly mixed in a thermoplastic material including a fiber percentage ranging between about 50% and about 60%; and an outer shell arranged in surrounding relation relative to said head assembly whereby inhibiting the heads from separating from the hammer and the inner body, said outer shell being molded from a polyurethane material, and wherein the polyurethane material of said outer shell extends through the hollow configuration of the inner body to enhance vibration dampening characteristics of the hammer.

37. A composite hammer comprising:

a handle having an elongated body and a cradle attached to a terminal end of said body;

a head structure; and an outer elastomeric member encapsulating an outer surface portion of said cradle, and an inner elastomeric member encapsulating an inner surface portion of said cradle and at least partially encapsulating said head structure to thereby secure said head structure to said handle.

* * * * *